US007389719B2

(12) United States Patent
Curry

(10) Patent No.: US 7,389,719 B2
(45) Date of Patent: Jun. 24, 2008

(54) WIRE BUSHING FOR USE WITH A FIREARM BARREL

(75) Inventor: Brett Curry, Chicopee, MA (US)

(73) Assignee: Smith & Wesson Corp., Springfield, MA (US)

( * ) Notice: Subject to any disclaimer, the term of this patent is extended or adjusted under 35 U.S.C. 154(b) by 194 days.

(21) Appl. No.: 11/316,528

(22) Filed: Dec. 22, 2005

(65) Prior Publication Data

US 2006/0185508 A1 Aug. 24, 2006

Related U.S. Application Data

(60) Provisional application No. 60/639,187, filed on Dec. 22, 2004, provisional application No. 60/638,753, filed on Dec. 22, 2004, provisional application No. 60/638,752, filed on Dec. 22, 2004, provisional application No. 60/638,751, filed on Dec. 22, 2004, provisional application No. 60/638,746, filed on Dec. 22, 2004, provisional application No. 60/638,594, filed on Dec. 22, 2004, provisional application No. 60/638,593, filed on Dec. 22, 2004, provisional application No. 60/638,592, filed on Dec. 22, 2004.

(51) Int. Cl.
*F41A 3/88* (2006.01)
*F41A 25/22* (2006.01)

(52) U.S. Cl. ..... 89/196; 42/14; 42/16

(58) Field of Classification Search ..... 89/196; 42/14, 16, 77, 76.01
See application file for complete search history.

(56) References Cited

U.S. PATENT DOCUMENTS 1,348,284 A * 8/1920 Loomis ..... 89/196
2,898,693 A * 8/1959 Ruger ..... 42/77
3,564,967 A * 2/1971 La Violette et al. ..... 89/163
3,975,982 A * 8/1976 Terstegge ..... 89/163
4,011,678 A 3/1977 Brodbeck et al.
4,031,648 A 6/1977 Thomas
4,178,833 A * 12/1979 Miller ..... 89/163
4,522,105 A 6/1985 Atchisson
4,539,889 A 9/1985 Glock
4,715,140 A * 12/1987 Rosenwald ..... 42/97
4,825,744 A 5/1989 Glock
4,893,546 A 1/1990 Glock
4,967,724 A 11/1990 Senfter
5,012,604 A 5/1991 Rogers
5,018,292 A 5/1991 West
5,024,139 A 6/1991 Knight, Jr. et al.

(Continued)

*Primary Examiner*—Bret Hayes
(74) *Attorney, Agent, or Firm*—McCormick, Paulding & Huber LLP

(57) ABSTRACT

A firearm such as a semiautomatic pistol or handgun includes a barrel and a slide with a front aperture for rearward movement of the slide around the barrel during cycling of the slide between forward and rearward positions. A wire bushing is provided between the outer diameter of the barrel and the inner diameter of the aperture of the slide for positioning the barrel within the aperture during cycling. The wire bushing is a spring-like, generally round or O-shaped member (e.g., a bent metal wire) mounted within a groove provided in the slide aperture, with portions of the bushing being bent to lie out of the groove for contacting the barrel. The wire bushing reduces the tolerances between the slide and the barrel, thereby improving operation of the firearm, improves re-location of the barrel within the slide, provides for easier maintenance, and reduces mass, cost, and complexity.

19 Claims, 3 Drawing Sheets

U.S. PATENT DOCUMENTS 5,036,612 A 8/1991 Jennings
5,050,480 A 9/1991 Knight, Jr. et al.
5,050,481 A * 9/1991 Knight et al. ..... 89/147
5,081,780 A 1/1992 Lishness et al.
5,086,578 A 2/1992 Lishness et al.
5,086,579 A 2/1992 Flatley et al.
5,088,222 A 2/1992 Larson
5,090,147 A 2/1992 Pastor
5,105,570 A 4/1992 Lishness et al.
5,115,588 A 5/1992 Bronsart et al.
5,119,634 A 6/1992 Berry et al.
5,149,898 A 9/1992 Chesnut et al.
5,157,209 A 10/1992 Dunn
5,160,796 A 11/1992 Tuma et al.
5,164,534 A 11/1992 Royster
5,166,458 A 11/1992 Yoo
5,187,312 A 2/1993 Osborne
5,195,226 A 3/1993 Bornancini
5,216,191 A 6/1993 Fox
5,216,195 A 6/1993 Tuma
5,225,612 A 7/1993 Bernkrant
5,235,770 A 8/1993 Simon et al.
5,241,769 A 9/1993 Von Muller
5,247,757 A 9/1993 Deeb
5,251,394 A 10/1993 Bornancini
5,267,407 A 12/1993 Bornancini
5,272,957 A 12/1993 Chesnut et al.
5,299,374 A 4/1994 Mathys
5,303,494 A 4/1994 Tuma et al.
5,327,810 A 7/1994 Sandusky et al.
5,349,939 A 9/1994 Perrone
5,355,768 A 10/1994 Felk
5,373,775 A 12/1994 Findlay, Sr. et al.
5,386,659 A 2/1995 Vaid et al.
5,388,362 A 2/1995 Melcher
5,400,537 A 3/1995 Meller et al.
5,412,894 A 5/1995 Moon
5,417,001 A 5/1995 Rousseau
5,426,881 A 6/1995 Ruger
5,438,784 A 8/1995 Lenkarski et al.
5,448,939 A 9/1995 Findlay, Sr. et al.
5,487,233 A 1/1996 Jewell
5,493,806 A 2/1996 Langevin et al.
5,502,914 A 4/1996 Moon
5,517,896 A 5/1996 Perrine
5,548,914 A 8/1996 Anderson
5,570,527 A 11/1996 Felicci
5,581,927 A 12/1996 Meller
5,604,326 A 2/1997 Lescure
5,606,825 A 3/1997 Olsen
5,615,507 A 4/1997 French
5,623,114 A 4/1997 Soper
5,625,971 A 5/1997 Tuma et al.
5,634,456 A 6/1997 Perrone
5,635,664 A 6/1997 Pons et al.
5,640,794 A 6/1997 Gardner et al.
5,654,519 A * 8/1997 Albrecht et al. ..... 89/163
5,655,326 A 8/1997 Levavi et al.
5,669,169 A 9/1997 Schmitter et al.
5,680,722 A 10/1997 French et al.
5,697,178 A 12/1997 Haskell
5,701,698 A 12/1997 Wesp et al.
5,709,046 A 1/1998 Canaday
5,711,286 A 1/1998 Petrosyan et al.
5,713,150 A 2/1998 Ealovega
5,717,156 A 2/1998 Lenkarski
5,718,074 A 2/1998 Keeney
5,736,667 A 4/1998 Munostes et al.
5,760,328 A 6/1998 Robbins
5,770,814 A 6/1998 Ealovega
5,778,585 A 7/1998 Sigg
5,797,206 A 8/1998 Vitorino
5,806,225 A 9/1998 Gardner et al.
5,815,973 A 10/1998 Hochstrate
5,826,362 A 10/1998 Lyons
5,834,678 A 11/1998 Kalb
5,852,891 A 12/1998 Onishi et al.
5,857,280 A 1/1999 Jewell
5,906,066 A 5/1999 Felk
5,913,261 A 6/1999 Guhring et al.
5,974,717 A 11/1999 Brooks
5,987,796 A 11/1999 Brooks
6,000,162 A 12/1999 Hochstrate
6,070,512 A 6/2000 Rohrbaugh
6,125,735 A 10/2000 Guhring
6,131,324 A 10/2000 Jewell
6,164,001 A 12/2000 Lee
6,205,694 B1 3/2001 Davis, Sr.
6,240,669 B1 6/2001 Spaniel et al.
6,253,479 B1 7/2001 Fuchs et al.
6,256,918 B1 7/2001 Szabo
6,256,920 B1 7/2001 Olson
6,263,607 B1 7/2001 Fuchs et al.
6,266,909 B1 7/2001 Fuchs et al.
6,272,783 B1 8/2001 Dumortier et al.
6,289,619 B1 9/2001 Fuchs et al.
6,293,039 B1 9/2001 Fuchs
6,341,442 B1 1/2002 Szabo et al.
6,354,032 B1 3/2002 Viani
6,367,186 B1 4/2002 Gibala
6,381,892 B1 5/2002 Szabo et al.
6,382,200 B1 5/2002 Levkov
6,405,631 B1 * 6/2002 Milek ..... 89/139
6,412,206 B1 7/2002 Strayer
6,415,702 B1 7/2002 Szabo et al.
6,425,199 B1 7/2002 Vaid et al.
6,513,273 B2 2/2003 da Silveira
6,519,887 B1 2/2003 Allen et al.
6,539,658 B1 4/2003 Hubert et al.
6,543,169 B2 4/2003 Bero
6,553,706 B1 4/2003 Gancarz et al.
6,557,288 B2 5/2003 Szabo
6,560,909 B2 5/2003 Cominolli
6,588,136 B2 7/2003 Baker et al.
6,601,331 B2 8/2003 Salvitti
6,615,527 B1 9/2003 Martin
6,640,478 B2 11/2003 Johansson
6,643,968 B2 11/2003 Glock
6,655,066 B2 12/2003 Fluhr
6,665,973 B1 12/2003 Peev
6,688,210 B2 2/2004 Bubits
6,705,036 B2 3/2004 Orr
6,711,842 B1 3/2004 Chapman
6,718,680 B2 4/2004 Roca et al.
6,732,464 B2 5/2004 Kurvinen
6,735,897 B1 5/2004 Schmitter et al.
6,769,208 B2 8/2004 Beretta
6,789,342 B2 9/2004 Wonisch et al.

* cited by examiner

WIRE BUSHING FOR USE WITH A FIREARM BARREL

This application claims the benefit of the following U.S. Provisional Applications: Ser. No. 60/639,187; Ser. No. 60/638,594; Ser. No. 60/638,753; Ser. No. 60/638,593; Ser. No. 60/638,746; Ser. No. 60/638,592; Ser. No. 60/638,751; and Ser. No. 60/638,752, all filed Dec. 22, 2004, and all hereby incorporated by reference herein in their entireties.

FIELD OF THE INVENTION

The present invention relates generally to firearms and, more particularly, to a bushing for a barrel of a semiautomatic pistol or handgun.

BACKGROUND OF THE INVENTION

In the operation of certain tilting barrel Browning-type semiautomatic pistols or handguns, a slide element is cycled relative to a frame between battery and retired positions via the firing of cartridges. As a cartridge is fired, the slide is driven rearward into the retired position. A spring provides for the return of the slide in the forward direction and in the process replenishes the handgun with a fresh cartridge stripped from a magazine.

As the slide is driven rearward, an aperture in the front of the slide allows the slide to move rearward around the barrel. The barrel is supported at its rearward end via a lug on the barrel, the rearward portion of the lug being ramped to receive the next cartridge in preparation for firing. Tolerance between the slide and the lug allows the slide and the barrel to be decoupled as the slide moves rearward. When the slide moves rearward, the forward end of the barrel moves upward, which facilitates the feeding of a fresh cartridge.

In order to locate the position of the barrel within the slide from shot to shot, clearances must exist between the outer diameter of the barrel and the inner diameter of the aperture of the slide through which the barrel is received every time the slide is cycled (either manually or during firing). Various methods exist for locating the barrel within the aperture. One method incorporates spherical bushings or bearings into the aperture of the slide at the points of contact. Such bushings or bearings, while being effective to consistently locate the barrel during cycling, generally complicate the structure of the handgun, add mass, are costly, and make the gun difficult to assemble. The use of spherical bushings typically requires that large tolerances exist between the points of contact on the slide and the barrel.

SUMMARY OF THE INVENTION

A firearm such as a semiautomatic pistol or handgun includes a barrel and a slide with a front aperture for rearward movement of the slide around the barrel during cycling. An embodiment of the present invention provides a wire bushing between the outer diameter of the barrel and the inner diameter of the aperture of the slide. The wire bushing reduces the tolerances between the slide and the barrel, thereby improving operation of the firearm. The wiring bushing also provides for improved re-location of the barrel within the slide during cycling of the slide.

One advantage of using a wire bushing between the outer diameter of the barrel and the inner diameter of the aperture of the slide, as described herein, is that the overall mass of the handgun is easily reduced. Reducing the mass improves the comfort level of the firearm. Utilizing a wire bushing also reduces the complexity associated with firearms in which bearings are used as the contact point between the slide and the barrel, reduces cost, and provides for easier maintenance.

In one embodiment, the wire bushing is provided as a spring-like wire that is bent to a shape that provides the desired contact between the barrel and the slide. The wire bushing may be generally round in shape (meaning round in overall shape except as possibly to sections bent or otherwise extending inwards for contacting the barrel) to substantially conform to and fit within a groove provided in the slide aperture, into which the wire bushing is mounted. Certain portions of the wire may deviate from the conforming configuration to contact the barrel.

BRIEF DESCRIPTION OF THE DRAWINGS

The present invention will be better understood from reading the following description of non-limiting embodiments, with reference to the attached drawings, wherein below.

DETAILED DESCRIPTION

Figure 1:
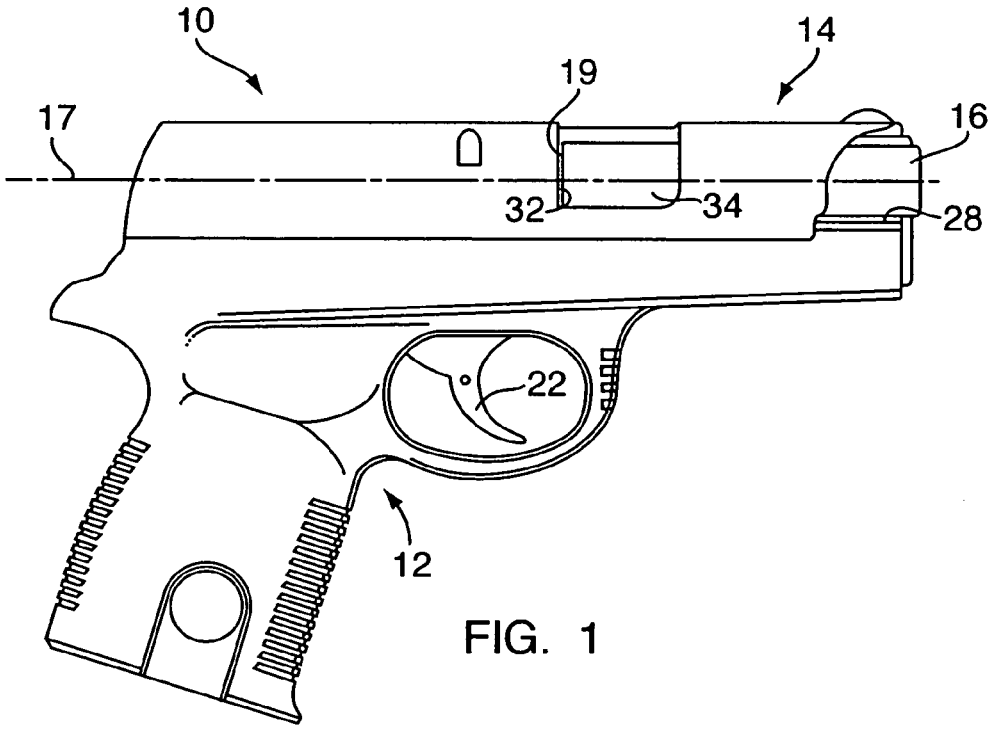
FIG. 1 is a simplified schematic side view of a semiautomatic pistol.
Figure 2:
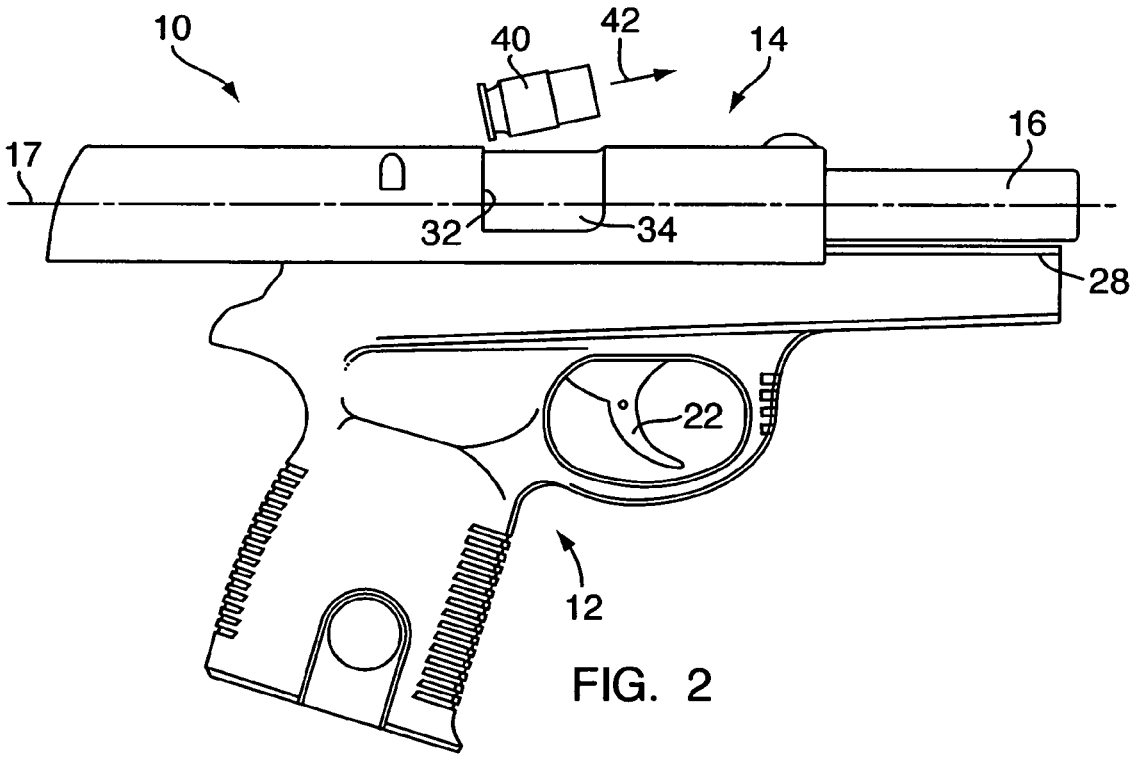
FIG. 2 is a simplified schematic side view of the pistol of FIG. 1 shown with the slide moved to a rearward position on the pistol frame.

FIGS. 1 and 2 show one example of a semiautomatic pistol or handgun (hereinafter referred to as "firearm 10") that may incorporate a wire bushing 70 according to an embodiment of the present invention. The firearm 10 comprises a frame 12, a slide 14, and a fire control mechanism that operates via actuation of a trigger 22. The frame 12 is fabricated of a high-impact polymer material, metal, a combination of polymer and metal, or other suitable material. The slide 14 houses a barrel 16 in the forward end thereof. The barrel 16 is cooperatively linked with the slide 14 and, together with the slide 14, defines a longitudinal firing axis 17. A rearward end 19 of the barrel 16 is adapted for receiving an ammunition cartridge.

The slide 14 is fitted to oppositely positioned slide rails 28 on the frame 12 to effect the reciprocal movement of the slide 14 along the longitudinal firing axis 17. The rails 28 extend along the underside of the slide 14 in the longitudinal direction and are cooperative with the frame 12 to allow the cycling of the slide 14 between forward (battery) and rearward (retired) positions, as shown in FIGS. 1 and 2, respectively. The slide 14 further includes a breech face 32 and an extractor port 34. The breech face 32 is engagable with the rearward end 19 of the barrel 16 to form a firing chamber when the slide 14 is disposed forwardly on the frame 12 (FIG. 1). An ejection mechanism provides for the ejection of a cartridge casing 40 in a direction indicated by an arrow 42 upon firing the firearm 10 or manually cycling the slide 14.

Figure 3:
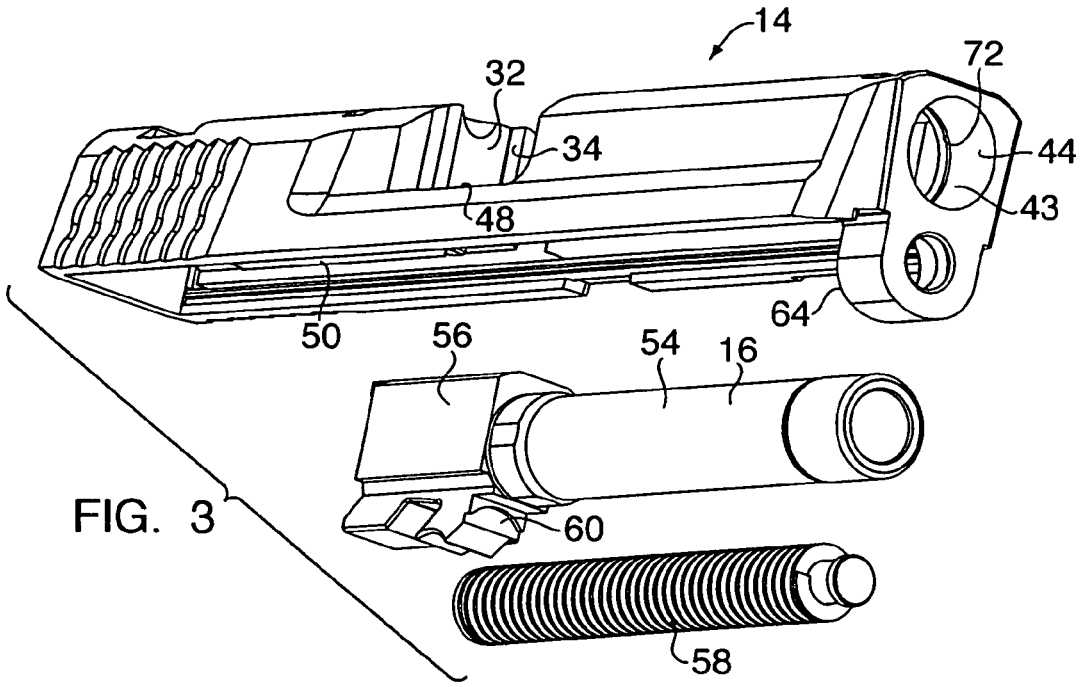
FIG. 3 is a simplified schematic exploded perspective view of a slide of a semiautomatic pistol.

Referring now to FIG. 3, the slide 14 has a dosed rearward end and an open forward end at which an aperture 43 is positioned. The forward-most surface of the dosed rearward end is the breech face 32. The breech face 32 includes an opening 48 through which the forward end of the firing pin is received to strike a cartridge (not shown) and fire the handgun. The undersurface of the closed rearward end of the slide 14 also includes a pickup rail 50. The pickup rail 50, upon operation of the handgun, functions to strip cartridges from the magazine and urge the cartridges into position to be fired.

The open forward end of the slide 14 houses the barrel 16 through which projectiles of the fired cartridges are directed. The barrel 16 includes a tubular portion 54 that is receivable through the aperture 43 at the forward end of the slide 14 and a rearward portion 56 that, when the barrel 16 is mounted in the slide 14, doses the extractor port 34 through which spent cartridge casings are ejected. A recoil spring 58 is operatively engaged with the barrel 16. The operative engagement of the recoil spring 58 with the barrel 16 is effected by the mounting of the recoil spring 58 at a surface 60 of the barrel 16 and at a surface 64 on the slide 14 to allow the slide 14 to be biased rearward into the retired position relative to the barrel 16 and the frame during operation or manual cycling of the handgun.

Figure 4:
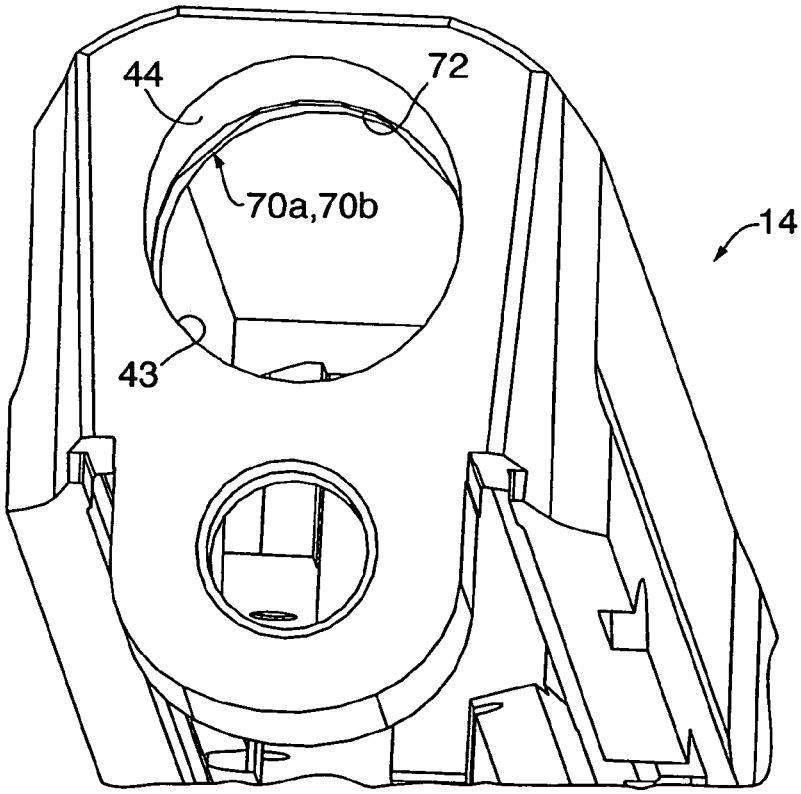
FIG. 4 is a simplified schematic perspective view of the slide of FIG. 3 showing an aperture in which a wire bushing is accommodated.
Figure 6A:
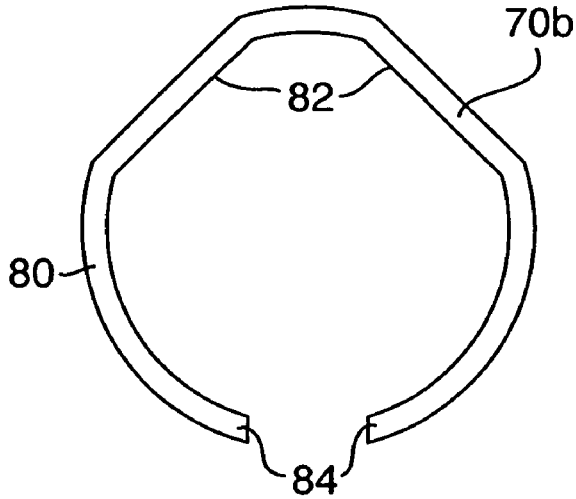
Figure 6B:
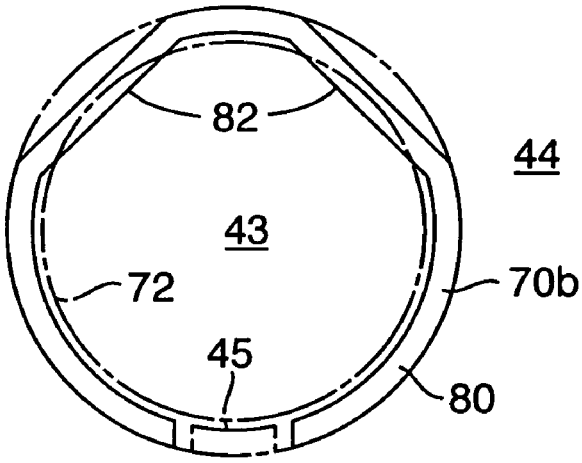
FIG. 6B is a cross sectional view of a portion of the slide showing the wire bushing of FIG. 6A in place.

Referring now to FIGS. 4 and 6B, a wire bushing 70*a*, 70*b* is located within a groove 72 in the defining surfaces of the aperture 43 at the forward end of the slide 14. For example, the aperture 43 will typically be defined by a cylindrical sidewall 44 extending from the fore end of the slide part ways down the longitudinal axis of the slide. The groove 72 may comprise a shallow channel, generally coaxial with the slide axis, formed in the sidewall 44. The groove 72 may span the circumference of the sidewall 44/aperture 43, but more typically there will be a break or discontinuity in the groove as provided by a shoulder 45, e.g., the groove may be generally C-shaped in longitudinal cross section, for maintaining proper placement and orientation of the wire bushing 70*a*, 70*b* (see FIG. 6B). The groove 72 is dimensioned to have a depth that accommodates portions of the wire bushing 70*a*, 70*b* completely within the groove 72 while allowing other portions of the wire bushing 70*a*, 70*b* to extend out of the groove 72 and into the aperture 43. For example, the inner diameter of the wire bushing 70*a*, 70*b* may engage the outer diameter of the barrel at approximately the ten o'clock and two o'dock positions. Spring-like characteristics of the wire bushing 70*a*, 70*b* urge the barrel downward in the direction of the six o'dock position of the aperture 43 to consistently relocate the position of the barrel and to accommodate upward motion of the barrel as necessary. The wire bushing 70*a*, 70*b* provides sufficient contact between the slide 14 and the barrel at the ten o'clock and two o'clock positions such that when the slide 14 is cycled the barrel is consistently re-located to the same position within the slide 14.

Figure 5:
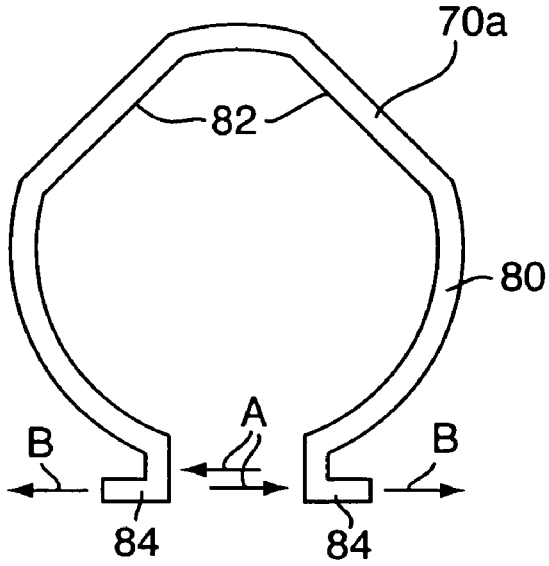
FIGS. 5 and 6A are simplified schematic elevational views of embodiments of wire bushings of the present invention.

Referring now to FIGS. 5, 6A, and 6B, the wire bushing 70*a*, 70*b* (barrel locating means) comprises a wire 80 that is bent to a shape that provides the desired contact between the barrel and the slide. The wire 80 will typically substantially conform to the orientation/configuration of the groove in which the wire bushing 70*a*, 70*b* is mounted. Distances along the length of the wire 80, however, deviate from the conforming configuration to provide "extension" portions 82 of the wire 80 that contact the barrel (e.g., as stated above, at the ten o'clock and two o'dock positions). In other words, when deployed in the groove 72, portions 82 of the bushing 70*a*, 70*b* extend out past the peripheral lip of the groove and into the aperture 43 for contacting the barrel 16. As is shown in FIG. 5, the wire 80 of the bushing 70*a* may have two terminal ends 84 that define surfaces/tabs that can be grasped with fingers, pliers, or the like and manipulated to compress the wire bushing 70*a*, thereby facilitating its removal from the groove. In the embodiment shown, the wire 80 may approximate the shape of the Greek letter "omega." As shown in the embodiment in FIGS. 6A and 6B, the terminal ends 84 of the wire 80 of the bushing 70*b* may be configured to fit within the groove, thereby requiring the wire 80 to be pulled out by the portions 82 of the wire 80 that protrude out of the groove.

The wire 80 will typically be formed from a metal or other material having sufficient hardness to withstand the environment of a firearm. Furthermore, the metal from which the wire 80 is formed is sufficiently ductile to allow it to be formed into a clip-like structure or member having a spring rate that allows for the retention of the bushing formed from the wire 80 in a groove in a slide of a firearm. (For example, with reference to FIG. 5, when compressed in direction "A" the bushing will tend to flex outwards in a direction "B.") Moreover, the wire 80 is of sufficient softness so as to buffer the frictional contact encountered during cycling of the slide. In particular, the wire 80 may be fabricated from a metal that is at least as soft as the metals from which the surfaces of the aperture and the barrel are formed. Alternatively, the wire 80 may be coated with a softer metal to impart lubricious qualities to the wire bushing 70.

In one embodiment of the present invention, as described above, a semiautomatic firearm comprises a frame, a slide mounted on the frame and reciprocal thereon, and a barrel mounted inside the slide. The slide has a forward end for housing the barrel and a rearward end in which is housed a firing pin that cooperates with a trigger assembly and a fire control mechanism mounted in the frame. The slide includes an aperture positioned in the forward end thereof to accommodate the barrel and to receive the barrel therethrough as the slide cycles rearward. The aperture at the front of the slide includes a groove disposed therein. A wire bushing is disposed in the groove to locate the position of the barrel in the slide during cycling of the slide.

In another embodiment of the present invention, as described above, a slide for a semiautomatic firearm is mountable on a frame and is capable of receiving a barrel longitudinally therein such that upon operation of the slide in conjunction with a frame of the firearm, the barrel is longitudinally received through an aperture at the front of the slide. The defining surfaces of the aperture include a groove in which a wire bushing is housed. The wire bushing allows for dose tolerances to be maintained between the slide and the barrel and provides for consistent re-location of the barrel during cycling of the slide.

In yet another embodiment of the present invention, as described above, a bushing for a slide of a semiautomatic firearm comprises a length of wire. The wire is configured for placement in a groove in an aperture of the front of the slide through which a barrel of the firearm extends upon cycling the slide. The wire has a substantially round configuration having two terminal points and at least one portion that deviates from the substantially round configuration. The deviation of the at least one portion is a bend in the wire in the direction of the center of the substantially round configuration. When configured in this manner, the wire defines an interior diameter that provides a close tolerance fit with an outer surface of the barrel.

The wire bushing 70*a*, 70*b* may be characterized as having one or more arcuate portions positioned entirely within the groove 72. These portions do not contact the barrel. The wire bushing further includes one or more straight/linear sections 82 integral with the arcuate portions. The straight sections are configured to at least partially extend beyond the confines of the groove to lie within the aperture for contacting the barrel. The arcuate portion can be thought of as defining a circle circumscribing a perimeter of the wire bushing (see FIG. 6B), with the straight sections defining chords on said circle.

As should be appreciated, the portions 82 of the wire bushing 70*a*, 70*b* configured to extend out past the edge or lip of the aperture groove 72 may be formed in a manner other than bending, and may be configured other than as shown in FIGS. 5 and 6 for providing a different degree or character of contact between the barrel and bushing.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of this disclosure.

What is claimed is:

1. A firearm comprising:

a slide having a front aperture defined by a sidewall;

a barrel operably aligned with the slide and extending through the front aperture at least when the slide cycles between fore and rear positions;

a bushing groove formed in the aperture sidewall; and a wire bushing disposed in the bushing groove and configured for locating the barrel with respect to the aperture and slide, wherein the wire bushing has first and second ends, and wherein the bushing groove is interrupted by at least one shoulder attached to the aperture sidewall for positioning the wire bushing, at least one of said first and second ends of said wire bushing abutting said at least one shoulder.

2. The firearm of claim 1 wherein the wire bushing comprises a generally round spring member.

3. The firearm of claim 2 wherein the spring member comprises at least one first portion positioned entirely within the groove and at least one second portion integral with the at least one first portion, said at least one second portion being at least partially positioned outside the groove and within the aperture for contacting the barrel.

4. The firearm of claim 1 wherein the wire bushing comprises at least one first portion positioned entirely within the groove and at least one second portion integral with the at least one first portion, said at least one second portion being at least partially positioned beyond the groove and within the aperture for contacting the barrel.

5. The firearm of claim 4 wherein the wire bushing further comprises at least two of said second portions.

6. The firearm of claim 5 wherein the at least two second portions are respectively centered at a 10 o'clock position and a 2 o'clock position of the aperture, a top of said slide defining a 12 o'clock position of the aperture.

7. The firearm of claim 5 wherein:

the at least one first portion is arcuate in shape and defines a circle circumscribing a perimeter of the wire bushing; and each of said at least two second portions comprises a straight section of said wire bushing defining a chord of said circle.

8. The firearm of claim 4 wherein:

the at least one first portion is arcuate in shape and defines a circle circumscribing a perimeter of the wire bushing; and the at least one second portion comprises a straight section of said wire bushing member defining a chord of said circle.

9. The firearm of claim 1 wherein the wire bushing further comprises first and second tabs respectively attached to the first and second ends of the wire bushing for facilitating compression of the wire bushing for insertion into said groove.

10. The firearm of claim 1 wherein the wire bushing comprises a section of wire defining said first and second ends and formed into a generally circular shape.

11. The firearm of claim 10 wherein the wire bushing further comprises first and second tabs respectively attached to the first and second ends of the wire bushing for facilitating compression of the wire bushing for insertion into said groove.

12. A firearm comprising:

a slide having a front aperture;

a barrel operably aligned with the slide and extending through the front aperture at least when the slide cycles between fore and rear positions; and barrel locating means attached to the slide in the front aperture for locating the barrel with respect to the aperture and slide during cycling of the slide.

13. A firearm comprising:

a slide having a front aperture defined by a sidewall;

a barrel operably aligned with the slide and extending through the front aperture at least when the slide cycles between fore and rear positions;

a bushing groove formed in the aperture sidewall; and a wire bushing disposed in the bushing groove and configured for locating the barrel with respect to the aperture and slide, wherein the wire bushing comprises a first portion and a second portion attached to the first portion, said second portion being at least partially positioned beyond the groove and within the aperture for contacting the barrel, and said first portion being positioned entirely within the groove so that the barrel does not contact any part of the wire bushing at the location of said first portion but instead directly contacts the slide at said location.

14. The firearm of claim 13 wherein each of said first and second portions of the wire bushing is a longitudinal portion of said wire bushing defining a radial extent of the wire bushing along the length of said portion.

15. The firearm of claim 14 wherein the wire bushing further comprises a third longitudinal portion at least partially positioned beyond the groove and within the aperture for contacting the barrel, said second and third portions being respectively centered at a 10 o'clock position and a 2 o'clock position of the aperture, a top of said slide defining a 12 o'clock position of the aperture.

16. The firearm of claim 14 wherein:

the first portion is arcuate in shape and defines a circle circumscribing a perimeter of the wire bushing; and the second portion comprises a straight section of said wire bushing defining a chord of said circle.

17. A wire bushing for locating a firearm barrel with respect to a firearm slide and slide aperture during cycling of said slide, said wire bushing comprising:

a generally round spring member having an arcuate portion and an extension portion attached to the arcuate portion, said arcuate portion defining, in lateral cross section of the wire bushing, an outer circular perimeter edge of the wire bushing and an inner circular edge of the wire bushing that is concentric with the outer circular edge, wherein along the length of the arcuate portion no part of the bushing extends radially inward into an inner circular area of the bushing defined by the inner circular edge, and said extension portion defining a chord of said inner circular edge that extends radially inward into the inner circular area for locating a barrel when the arcuate portion is located in a groove for holding the bushing.

18. The wire bushing of claim 17 wherein the wire bushing is adapted in size and shape for (i) the arcuate portion of the wire bushing to lie completely concealed within a groove in said slide within the aperture, so that in the region of the arcuate portion the barrel contacts the slide and not the wire bushing, and for (ii) the extension portion of the wire bushing to extend beyond the groove to lie within the aperture for contacting and locating the barrel.

19. The wire bushing of claim 17 wherein the wire bushing comprises:

first and second extension portions, and first, second, and third arcuate portions, said extension and arcuate portions being arranged longitudinally one after the other and each portion defining a radial innermost and outermost extent of the wireless bushing along the length of that portion, said first and third arcuate portions defining first and second spaced apart ends of the bushing, respectively, and said first, second, and third arcuate portions together defining the inner and outer circular edges of the bushing, and said first extension portion lying between the first and second arcuate portions and said second extension portion lying between the second and third arcuate portions, each of said first and second extension portions defining a straight chord of said inner circular edge that extends radially inward from the inner circular edge, wherein the first and second extension portions are respectively centered at a 10 o'clock position and a 2 o'clock position of the wire bushing, a 6 o'clock position of the wire bushing being defined by a space between the first and second ends of the wire bushing, and wherein an entire circular area lying coextensive with and defined by the inner circular edge of the arcuate portions is open and unoccupied by the wire bushing except for an area impinged upon and lying within the circular area by the extension portions.

* * * * *